United States Patent [19]

Chesnais et al.

[11] 4,346,955

[45] Aug. 31, 1982

[54] SELF-STRIPPING TERMINAL FOR AN ELECTRICAL CONNECTOR

[75] Inventors: Andre Chesnais, Choisy Le-Roi; Philippe Thiery, La Celle St. Cloud, both of France

[73] Assignees: Souriau & Cie, Boulogne-Billancourt; Socapex, Suresnes, both of France

[21] Appl. No.: 117,485

[22] Filed: Feb. 1, 1980

Related U.S. Application Data

[63] Continuation of Ser. No. 972,374, Dec. 22, 1978.

[30] Foreign Application Priority Data

Dec. 28, 1977 [FR] France ..... 77 39420
May 23, 1979 [FR] France ..... 79 13188

[51] Int. Cl.[3] ..... H01K 11/20
[52] U.S. Cl. ..... 339/97 R
[58] Field of Search ..... 339/97 R, 98

[56] References Cited

U.S. PATENT DOCUMENTS 3,162,501 12/1964 Wahl ..... 339/98
3,845,455 10/1974 Shoemaker ..... 339/97 R
4,035,049 7/1977 McKee ..... 339/97 R
4,040,702 8/1977 McKee et al. ..... 339/97 R
4,125,311 11/1978 Hoppe ..... 339/97 R
4,153,324 5/1979 Kukla ..... 339/97 R
4,291,935 9/1981 Badoz et al. ..... 339/97 R

*Primary Examiner*—Eugene F. Desmond
*Attorney, Agent, or Firm*—McAulay, Fields, Fisher, Goldstein & Nissen

[57] ABSTRACT

A self-stripping terminal for an electrical connector has a resilient fork formed of two prongs or limbs which extend towards each other, perpendicular to the longitudinal axis of the terminal. Defined between the ends of the prongs is an electrical conductor receiving slot formed with flat parallel walls and with a bevel configuration at the opening or mouth of the slot. The limbs are carried on resilient arms whereby the slot can resiliently open over a wide range of sizes to allow the terminal to accommodate a wide range of electrical conductor diameters and to be used repeatedly.

The terminal may also include a second fork which is turned towards the first fork and which may be a semi-rigid fork or another resilient fork. In either case, the second fork has a groove for retaining the conductor, thereby to prevent radial disengagement thereof from the fork.

The flat and bevel configuration is formed with walls that are parallel to the axis of the conductor received therein. This restrains cutting of the conductor core by sharp edges during insertion of the conductor and subsequent use of the terminal.

16 Claims, 5 Drawing Figures

SELF-STRIPPING TERMINAL FOR AN ELECTRICAL CONNECTOR

BACKGROUND OF THE DISCLOSURE

CROSS REFERENCE TO RELATED APPLICATION

This is a continuing application of copending application Ser. No. 972,374 filed Dec. 22, 1978 by the same inventors hereof, and incorporated herein by this reference.

DESCRIPTION OF THE PRIOR ART

The present invention relates to the field of electrical connectors for electrical elements. More particularly, the present invention relates to electrical connectors having a self-stripping terminal wherein an electrical conductor, having insulation thereon, can be inserted so as to have a portion of the insulation removed and electrical contact made with the conductor core. This is accomplished generally by employing a fork member which cuts through the electrical insulation and clamps the conductor core.

It is increasingly a requirement in electrical circuits, to reduce the size of connecting elements. This is expecially true in the ubiquitous semi-conductor electrical device field wherein miniaturization is standard. Although the various components in the miniaturized circuits are becoming smaller and smaller, it is still necessary in many cases to use connecting electrical conductors of the same diameter as in the larger circuits. This has led necessarily to the development of devices whereby these electrical conductors can be connected conveniently to miniaturized connecting elements. One such device is a contact terminal having forked self-stripping connection means or using small punches which, upon insertion of the wire lead into the contact terminal, can accomplish stripping and electrical contact in a confined space.

Normally, each contact terminal is anchored in an insulating support by means of retention elements, and has, at the end, a self-stripping element provided with one or more slots. The edges of the slots, when a solid core or multi-core wire is inserted therein, cuts through the insulation on the conducting core and clamps the conducting core to insure a tight electrical junction. This not only makes the electrical connection, but, at the same time, ensures a mechanical connection between the electrical conductor and the contact terminal in case of accidental strains from the outside acting on the electrical conductor—such as pulling, flexing, or vibrations.

Self-stripping connecting devices have an additional advantage which lies in the speed at which they can be used. They are therefore economical in the saving of time making the connection, especially when compared with conventional devices such as solder-less wound connections, solder connections or wire-printing connections.

However, prior self-stripping connecting devices suffer from a number of disadvantages inherent in their structure. These often comprise contact terminals which are cut out and bent in such a way that the self-stripping portion with which they are provided, is formed by rigid or semi-rigid forks unable to effectively accommodate various sized conductors, and subject to failure from repeated use due to a loss in clamping action.

An example of these prior art self-stripping terminals is disclosed in U.S. Pat. No. 3,162,501 and German Application No. 2,040,805. U.S. Pat. No. 3,162,501 discloses a pair of members in a form of a V, each of which is formed by cutting and bending towards each other, and in which two lugs are cut out from opposite sides of a U-shaped structure.

In general, the arrangement shown in U.S. Pat. No. 3,162,501 provides two V-shaped forks whose limbs or prongs are directly fixed at one end to the sides of the U-shaped structure. Their free ends are juxtaposed and exhibit limited resiliency, enabling them to be separated during the introduction of a conductor lead, to cut the insulation from the lead and clamp the conducting core therebetween. However, it is clear that this structure results in the tabs which form the prongs of the fork, acting like rigid beams fixed on the sides of the U-shaped structure. This is the result of the fact that they are cut from the sides. In addition, these semi-rigid or semi-resilient forks, bent from the cut out tabs of the sides of the U-shaped structure, retain the memory of the shaping operations they underwent. The result is that the introduction of large-diametered conductors between the prongs of the forks, can open the forks to such an extent that plastic deformation of the prongs takes place. The prongs will no longer snap together after the lead is disconnected, thereby making the connector useless for subsequent operations, and the clamping action is attenuated with respect to the larger conductor core. Thus, the prior art semi-resilient forks as disclosed in U.S. Pat. No. 3,162,501, do not allow a large number of connections or a range of conductor sizes to be effectively employed.

Furthermore, in the semi-resilient forks of U.S. Pat. No. 3,162,501, the edge of the lug which is disposed most inwardly forms a sharp cutting surface which is capable not only of cutting the insulation of the electrical conductor, but also very substantially cutting into the core of the conductor and even through some of the conducting strands, when the conductor has a multi-strand core. Also, the device shown in U.S. Pat. No. 3,162,501 operates by tightening the axial force by wedging action when the electrical conductor is pulled longitudinally out of the connector. This can also cause the conductor to be sheared through by the cutting edges or, at least, a great reduction in the mechanical strength of the conductor.

The conductor shown in German Application No. 2,040,805, uses a U-shaped leaf spring whose sides, urged resiliently toward one another, bear, at their free ends, the juxtaposed prongs which form a self-stripping fork. The prongs are wider than the sides which support them and are pre-stressed against one another. This device also constitutes a semi-resilient fork, and, when large diameter leads are introduced, it is difficult to prevent flattening and scraping away of metal from the core, with a consequent reduction in the diameter of the core. The result is a substantial altering of the characteristics of the conductor core as to tensile and bending strength, and, to a lesser extent, the electrical conductivity of the core, similar to that occurring with the device of U.S. Pat. No. 3,162,501.

It is therefore an object of the present invention to avoid the disadvantages of the prior art self-stripping connectors, while incorporating the advantages of the prior art connectors. More specifically, it is an object of the invention to provide a device which will strip insulation from various core sized conductors and thereafter make good electrical connection with the cores without substantially reducing the physical strength of the connector.

It is a further object of the invention to provide a self-stripping terminal that can be used repeatedly without a significant reduction in clamping force.

BRIEF DESCRIPTION OF THE INVENTION

According to the invention there is provided a self-stripping terminal, for an electrical connector, having a slot therein in which the core of a single-strand or multi-strand electrical conductor can be retained. The insulating sheath or casing of the electrical conductor is cut or displaced on being introduced into a bevel configuration at the opening or mouth of the slot, and the conductor is introduced and pressed down into the slot. The slot is formed by a fork having two adjacently disposed prongs or limbs. At least one of the limbs is carried by the free end of a resilient arm which is fixed at its other end to a structure which also carries the other of the limbs. The resilient arm resiliently bends, to permit the limbs of the fork to move apart when a conductor is introduced into the slot, and a progressively increasing force is required to engage the conductor in the slot. Once the conductor is pushed fully into the slot, a permanent resilient contact is maintained by the action of the resilient arm.

To form the fork member, the prongs or limbs extend opposite each other, perpendicularly to the longitudinal axis of the terminal, corresponding to the longitudinal axis of the electrical conductor connected to the terminal. The slot has flat walls which are parallel to each other and to the longitudinal axis of the terminal, and is disposed in alignment with a bevel configuration at the opening or mouth thereof. The bevel configuration itself is formed by inclined flat walls which extend parallel to the longitudinal axis of the terminal.

In such a self-stripping terminal, the operation of cutting the insulation can be ensured without scraping or reducing the section of the core. The conductor is pushed into the bevel configuration at the opening of the slot, and thereafter directed into the slot. The pressure force applied by the limbs to the conductor wire, which is made progressive, can push back and flatten the metal, without causing a noticeable reduction in its section. The resilient mechanical contact can ensure a permanent electrical contact, and these good connecting conditions may be achieved with conductors wherein the difference in diameters range up to 30% between the smallest diameter and the largest diameter. Advantageously, however, both of the two limbs of at least one fork of the terminal is carried by the unfixed end of a resilient arm.

If desired the resilient arms can be pre-stressed so that, in the initial condition, before any conductor has been inserted into the slot, the pre-stressed arms cause the limbs to bear against each other to close the slot. This arrangement makes it possible to achieve a virtually constant pressure force of the limbs of the resilient fork against the cores of conductors of different diameters, which may themselves be protected by insulating sheaths of different thicknesses and different materials.

In a preferred embodiment, the terminal comprises a U-shaped structure, with two resilient arms fixed thereto by mounting the resilient arms on side portions of the U-shaped structure. The resilient arms are bent towards the interior of the profile of the U-shaped structure and are inclined with respect to the longitudinal axis of the terminal. In addition, the fork limbs carried by the resilient arms can be attached to the arms which carry them by a rounded portion.

Each resilient arm can be separated from the base of the U-shaped structure by a cut-out portion provided along the base. This provides a free cantilever supported resilient arm on which the limbs forming the slot, are supported.

Further advantages of the present invention structure includes that the terminal can be housed in a chamber of simple shape formed in an insulating carrier of a connector. The carrier provides for stiffening of the fixing of the resilient arms by bearing against the sides of the chambers of the insulating carrier, and for improvement in the resilient mounting of the arms.

The self-stripping terminal, in addition to the resilient fork described above, may include a semi-rigid fork comprising two rigid limbs which are separated by a slot, mounted on an extended portion of the base.

It is also possible for the terminal to have a further resilient fork with the two resilient forks facing each other, each resilient fork comprising two limbs which are carried by the two non-fixed ends of two resilient arms in turn fixed by attachment of their other end to the side portions of a U-shaped structure, the two U-shaped structures being connected by a common base.

In this case, in order to retain the conductor to prevent it from any radial disengagement through the slots in the forks, the U-shaped structure of one of the resilient forks is arranged to permit said terminal to cooperate with a connection terminal of complementary shape, the other resilient fork being such that each of its limbs has a groove to retain the conductor to prevent it from being radially disengaged by way of the slots of the forks.

The groove is advantageously in the form of a cut-out portion in the limb, which opens onto the slot and towards the base. The part of the slot which is closest to the base is formed wider than the part of the slot which is closest to the bevel configuration, these two parts each being defined between two flat walls which are parallel to each other and to the longitudinal axis of the terminal. The walls of the two parts are connected, on each limb, by a flat wall which is perpendicular to the walls.

Electrical connectors provided with terminals according to the invention, of complementary shapes and anchored in insulating carriers, can have the fixing of the resilient arms stiffened by the side portions of the U-shaped structure bearing against facing sides of the insulating carrier on which each terminal is anchored. Likewise, it is possible to provide that, after the slots have opened a predetermined amount, the fixing of the resilient arms is stiffened by a portion of the arms bearing against the sides of the insulating carrier.

DESCRIPTION OF THE PREFERRED EMBODIMENT

The contact terminals shown in FIGS. 1 to 5 are of female type, one end of which is arranged to permit cooperation with make-type terminals of complementary shape.

For better comprehension of FIGS. 1 to 5, means for anchoring the contact terminal in an insulating carrier of a connector, and an end-of-travel abutment with which the terminal may be provided in order to limit the introduction of a male terminal of complementary shape, are not shown.

Figure 1:
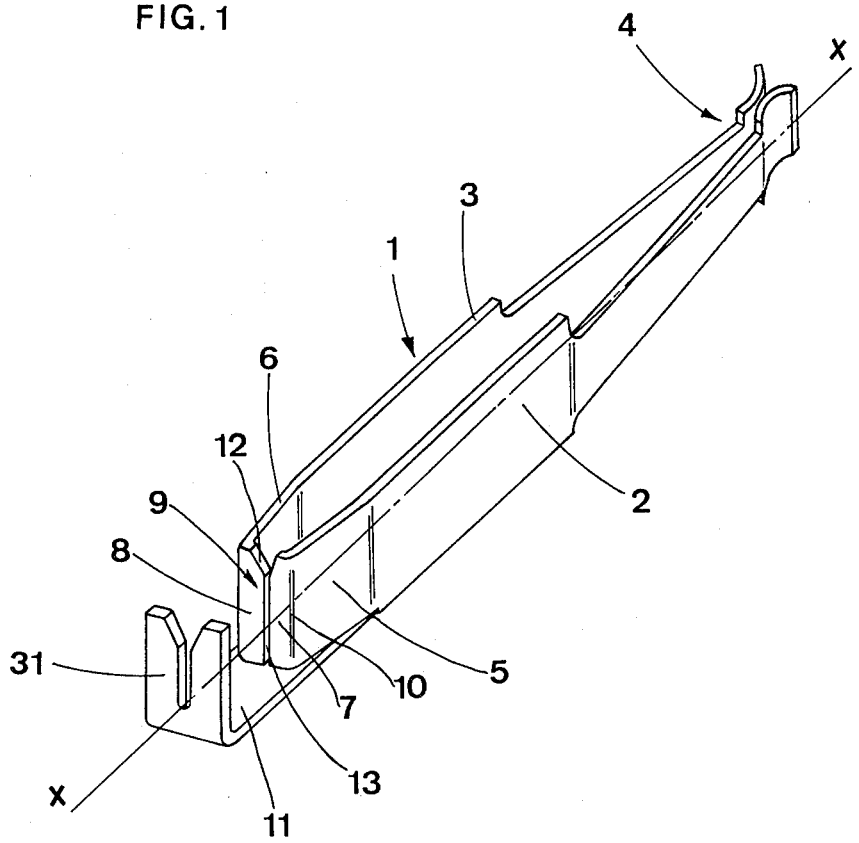
FIG. 1 shows a perspective view of a first embodiment of a self-stripping terminal according to the invention, provided with a resilient fork associated with a semi-rigid fork, of known kind.

Referring to FIG. 1, a contact terminal comprises a generally U-shaped structure 1 whose sides 2 and 3 are extended at one end to define resilient limbs of gripping means 4 of known shape, intended to permit the insertion and then the retention of a male terminal of complementary shape.

At the other end, the sides 2 and 3 are extended in the form of two resilient arms 5 and 6, to form, at their free ends, two limbs 7 and 8 of a fork 9 whose configuration is similar to that of a semi-rigid fork 31 of known kind, which is carried by the corresponding end of an extended base 11 of the U-shaped structure 1. However, the fork 9 is resilient since its limbs 7 and 8 are carried by resilient arms 5 and 6 which can flex as they are not rigid with the base 11 in the way that the sides 2 and 3 of the U-shaped structure are. In other words, sides 2 and 3 are received along one elongated edge thereof to the base 11 to form a rigid structure, while resilient arms 5 and 6 are free of base 11 and cantilever supported at one end to sides 2 and 3 only.

The resiliency of prongs or limbs 7 and 8 and their respective arms 5 and 6, is due to a rounded portion 10 whereby prongs 7 and 8 are secured to arms 5 and 6. In addition, the resilient arms 5 and 6 are bent inwardly of the configuration of the U-shaped structure 1 where they are secured to sides 2 and 3 respectively, to be inclined to the longitudinal axis X—X of the terminal. Note also that the axis X—X corresponds to the longitudinal axis of an electrical conductor when connected to the terminal.

The two limbs 7 and 8 extend opposite to each other, perpendicularly to the longitudinal axis X—X of the terminal, and between them they form a slot 13 with flat walls, which walls are parallel to each other and to the axis X—X. The slot 13 is also disposed in alignment with a bevel configuration 12 which forms a mouth into opening slot 13. Bevel configuration 12 is formed by inclined flat walls which are also parallel to the axis X—X.

Parallelism of the flat walls of the slot 13 with respect to each other and with respect to the axis X—X is required and should be maintained with a high degree of precision to ensure proper operation of the device with a minimum of physical degradation of the conductor. For example, when the width of the slot 13 in the rest condition is 0.15 mm, the variation of parallelism must be less than about 0.05 mm.

Upon inserting a conductor whose metal core is surrounded by an insulating sheath which may be of various thicknesses and nature, between the limbs 7 and 8 of the resilient fork 9, cutting and/or displacement of the insulating sheath occurs first. Then, when the conductor is introduced into the slot 13, the limbs 7 and 8 of the resilient fork 9 can move apart, while applying a progressive pressure force to the metal of the core of the conductor which is thus flattened and pushed back without any significant reduction in the core section. Good electrical contact without significant reduction in conductor resistance to breakage, is thereby accomplished.

Being of the circular section before the insertion operation, the core is progressively deformed by its section becoming oval, until it has two lateral flats against which the limbs 7 and 8 of the fork 9 resiliently bear to provide for a permanent electrical contact. The parallel nature of the walls as described above, restrains any cutting action to the metal conductor core.

Using a conductor core which is made of a metal of known properties, which has been subjected to a predetermined heat treatment, it is easy to select the width and the thickness of the resilient arms 5 and 6, the length of the resilient arms 5 and 6 from their fixing points, and the initial width of the slot 13, before engagement of a conductor therein, in order to make it possible to connect conductors whose cores have differences in diameter of 25 to 30% between the smallest and the largest diameter, or else in order to suit the pressure forces applied by the limbs 7 and 8 of the resilient form 9 to the core of a determined conductor.

In order for the conductor better to be held mechanically to the contact terminal, it is possible for the resilient fork 9 to have associated therewith semi-rigid fork 31 of known kind, comprising two rigid arms which are separated by a slot, as shown in FIG. 1. This is particularly useful where the size of such a terminal is to be limited, in order to ensure strong anchoring of the conductor.

Figures 2, 3:
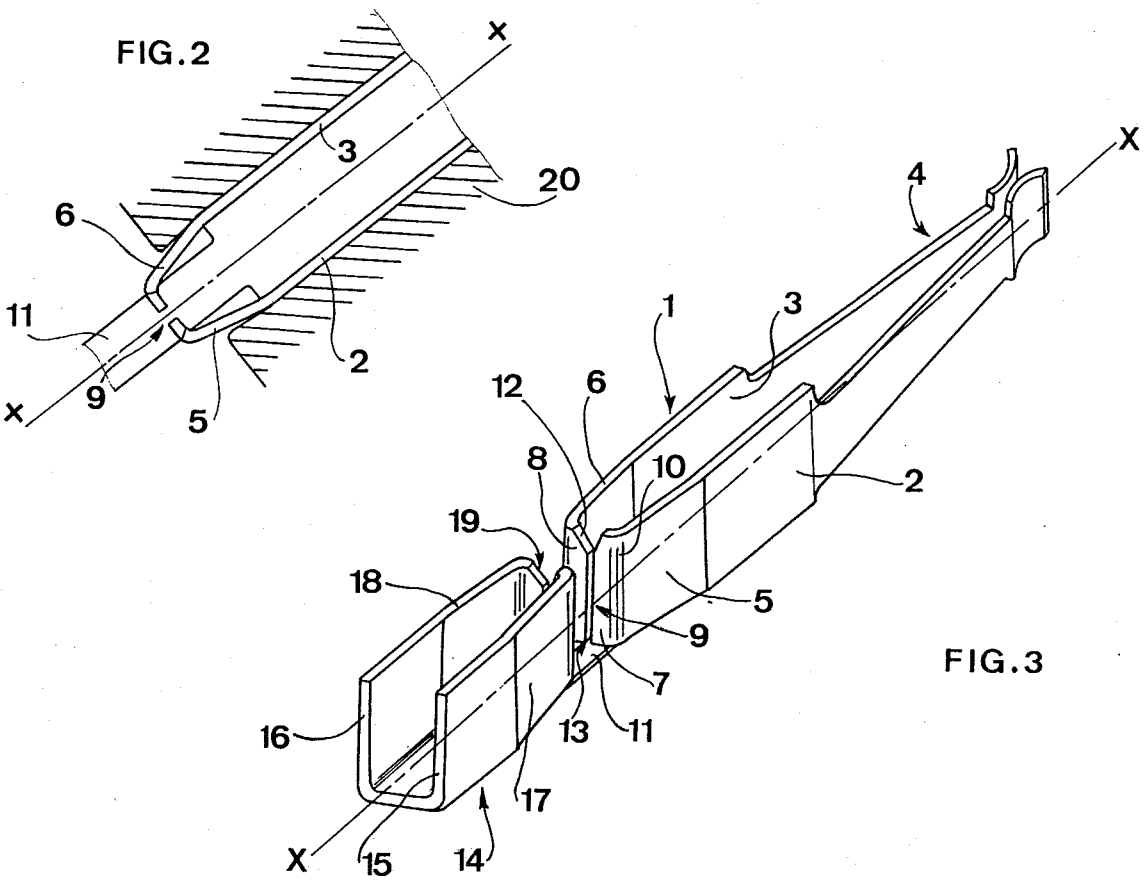
FIG. 2 shows a top plan view of the resilient fork of the terminal of FIG. 1 anchored in an insulating carrier.
FIG. 3 shows a perspective view of a second embodiment of a self-stripping terminal according to the invention, provided with two resilient forks.

The contact terminal which is provided with a resilient fork, as described hereinbefore, is anchored in an insulating carrier 20, FIG. 2. It is advantageous for the fixing of the resilient arms such as 5 and 6 to be stiffened or supported by providing for the sides 2 and 3 of the U-shaped structure 1 to bear against insulation carrier 20. It is advantageous to provide further, as illustrated in FIG. 2, that a portion of the side of carrier 20 bend inwardly, so that arms 5 and 6 also bear against the sides of the insulating carrier 20 when they have flexed outwardly a predetermined amount. The large support surface area thus obtained can avoid damage to the contact terminal when a conductor is connected or reconnected thereto, in contrast to what occurs with the terminals provided with forks of known kind.

Figure 4:
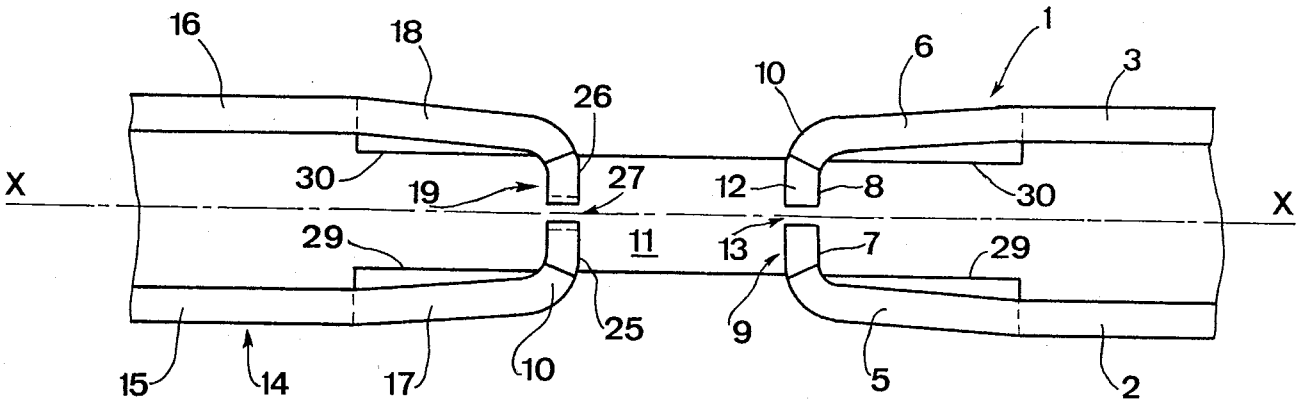
FIG. 4 shows of top plan view of part of the terminal of FIG. 3.

In another preferred embodiment, two resilient forks are associated, on the same terminal, as shown in FIGS. 3 and 4. The U-shaped structure 1 is connected to a second U-shaped structure 14 by way of their common base 11. Cantilever mounted to sides 15 and 16 of the U-shaped structure 14 are resilient arms 17 and 18 which carry prongs or limbs 26 and 26 of a second resilient fork structure 19. Second resilient fork 19 is turned towards the first fork 9 and is generally constructed in a similar manner to the fork 9. Thus, the limbs 25 and 26 oppose each other, extend perpendicular to the axis X—X and are connected by rounded portions 10 to the arms 17 and 18. Arms 17 and 18 are bent towards the interior of the configuration of the U-shaped structure 14 analogous to arms 5 and 6 of fork 9. The walls of slot 27 which slot is defined between the limbs 25 and 26, are parallel to each other and to the axis X—X.

Each of the resilient arm pairs 5,6 and 17,18 is separated from the base 11 of the U-shaped structures 1 and 14 by a cut-out portion 29 or 30 provided in the base 11, and extending to the junction of the arms 5, 6, 17 and 18, respectively, with the sides 2, 3, 15 and 16. The cut-out portions 29 and 30 thereby extend longitudinally below the arms 5 and 17, and 6 and 18 respectively, and transversely, towards the interior of the terminal, beyond the projections onto the plane of the base 11 of the arms 5 and 17, 6 and 18 respectively. In other words, arms 5, 6, 17 and 18 are cantilever supported and do not have a portion of base 11 under their lower edges.

Figure 5:
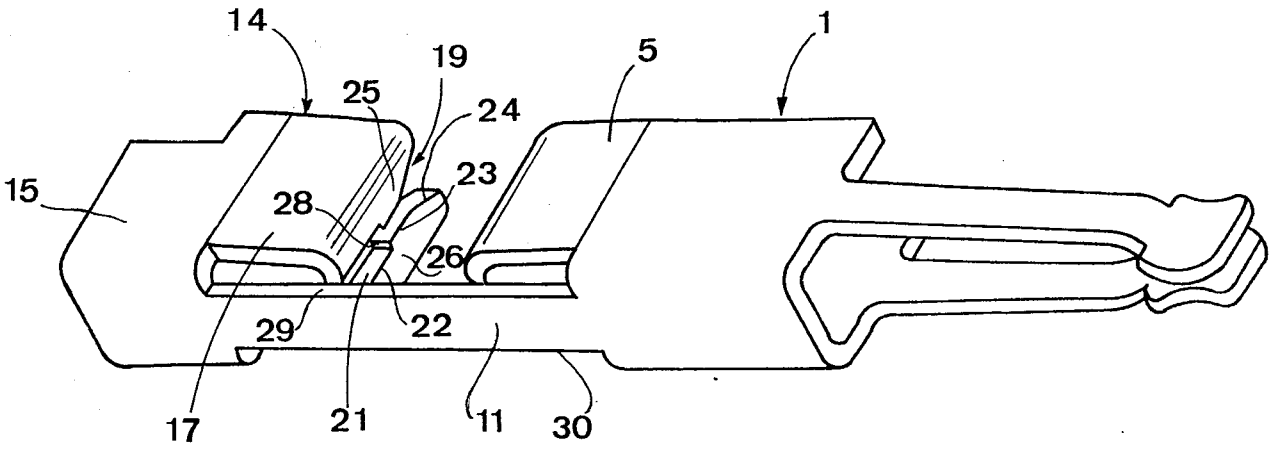
FIG. 5 shows a perspective view from below, of a modified embodiment of the terminal of FIG. 3, provided with complementary means for radially retaining a conductor.

In the two embodiments described with reference to FIGS. 1 to 3, it will be seen that the provision of a second fork, whether semi-rigid as at 31 or resilient as at 14, considerably improves mechanical holding of the conductor, compared with the holding action of the resilient fork 9 above. The second fork 31 or 14 acts to protect the electrical connection against longitudinal forces which may accidentally be applied to the conductor. However, this mechanical anchoring action is relatively weak in regard to possible stresses which produce forces in directions substantially parallel to the slots of the forks. FIG. 5 shows a terminal similar to that shown in FIGS. 3 and 4, which has been modified to remedy this weakness and which provides an anchoring action which is much better than that produced by means of the terminals shown in FIGS. 1 to 4. Identical components of the two terminals shown in FIGS. 3 and 4 will not be described again and will be denoted by the same reference symbols.

The feature differentiating a resilient fork 19 of FIG. 5 from the resilient fork 9 is a groove 21 in each of the limbs 25 and 26. The groove 21 is in the form of a cut-out portion in the limbs 25 and 26, which opens out of the slot 27 and towards the common base 11, so that a part 22 of the slot 27, which is closest to the base 11, is wider than a part 23 of the slot 27 which is closer to the bevel configuration 24 at the mouth of the slot in the fork 19. The two parts 22 and 23 each are defined between two flat walls which are parallel to each other and to the axis X—X, and the walls of the two parts 22 and 23 are connected, on each limb 25 or 26, by a shoulder formed as a flat wall 28 which is perpendicular thereto and which forms the operative part of the groove 21. As in the bevel configuration 12, the bevel configuration 24 is formed by inclined flat walls which are parallel to the axis X—X.

The terminal of FIG. 5 operates in the following manner: upon insertion of a conductor between the limbs 7 and 8 of the resilient fork 9 and between the limbs 25 and 26 of the resilient fork 19, as the conductor passes the bevel configurations 12 and 24 at the openings of the slots 13 and 27, the insulating sheath of the conductor is first cut and/or displaced. Then, when the conductor is introduced into the slots 13 and 27, the limbs 7 and 8 on the one hand and 25 and 26 on the other hand move apart, while applying a pressure force to the core of the conductor if the conductor is a single-strand conductor, or to the cluster of strands within the sheath if the conductor is a multi-strand conductor.

The core or cluster of strands, which was circular in section before the insertion operation, is deformed, into an oval configuration, until it has two lateral flats against which the limbs 7 and 8 of the fork 9 will constantly bear resiliently in order to ensure permanent electrical contact, as well as providing for excellent mechanical retention of the conductor to the terminal, capable of resisting any accidental longitudinal force applied thereto. The resilient force of the limbs 25 and 26 bearing against the core of cluster of strands will occur only while the core or cluster is passing through the narrower part 23 of the slot 27 of the fork 19. After the conductor has passed through that part 23, the limbs 25 and 26 of the fork 19 are resiliently pushed towards each other by the resilient arms 17 and 18 so that the fork 19 closes again and the conductor is held in the wider part 22 of the slot 27, thereby providing for radial anchoring of the conductor. In fact, any force applied in the direction of the slots 13 and 27 causes the conductor to bear against and be retained against the flat shoulder walls 28 which act as abutments, of the grooves 21, without the danger of causing the fork 19 to be opened.

The presence of a groove 21 on each of the limbs 25 and 26 of the fork 19 makes it possible to avoid the necessity for using either retaining elements which are integrated in the insulating carrier in which the terminal is positioned, or additional elements for holding the conductors in the forks, as is the case with the prior art self-stripping terminals, in particular those disclosed in U.S. Pat. No. 3,162,501.

In addition to the possible ways of adjusting the pressure forces which are applied to a given conductor, and the possibilities of connecting conductors of different diameters, which are provided by the self-stripping terminal with resilient fork, by virtue of the many parameters which it is easy to adjust, further substantial advantages can derive from the invention. In particular, the terminals with resilient fork may be re-cabled or revised a large number of times (from 10 to 20 times) without resulting in any substantial change in the mechanical and electrical characteristics of the connection. In addition, the terminals can provide for advantageous connection, in the case of multistrand conductors. Indeed, inserting such conductors in forks of known kind is often accompanied by the strands which come most into contact with the edges of the slot being cut, and relaxation of the cluster of strands tend to cause the cluster to become more oval than would be appropriate. Breaks in the electrical contact may then occur, if the terminal is subjected to vibration. The elastic forks however need not suffer from these disadvantages. On insertion of the multi-strand conductor, opening of the limbs of the fork makes it possible to avoid cutting the strands. The strands are simply displaced relative to each other and any relaxation of the cluster of strands is accompanied by a tightening of the limbs, due to the resilience of the arms, so that electrical continuity is ensured. Multi-strand or single-strand conductors can thus be connected with a high degree of stability in regard to contact resistance.

Finally, by association of resilient forks with forks of the same kind or with forks of a different kind, which are rigid or semi-rigid, on the same contact terminal, or within the same connector, it is possible to provide the connection with widely varying mechanical and electrical properties, thereby permitting a high degree of facility of adaptation to the space available for making the connection, or to the climatic conditions of use.

While there has been shown what is considered to be the preferred embodiments of the invention, it is obvious to those skilled in the art that various changes and modifications may be made therein without departing from the scope of the invention.

What is claimed is:

1. In a self-stripping terminal of the type wherein an electrical conductor simultaneously is stripped of its insulation and received in a slot defined between first and second opposed limbs of a forked member carried on a support structure, the conductor being supported in said terminal with its elongated central axis parallel to the longitudinal axis of said terminal, said limbs being substantially perpendicular to said longitudinal axis, the improvement comprising:

a first cantilever supported resilient arm supporting, with its free end said first limb with respect to said second limb;

said arm being substantially parallel to said longitudinal axis and substantially flexible in a plane parallel to said longitudinal axis;

said slot having first and second slot walls defined on said first and second limbs respectively, said first and second slot walls being substantially parallel to each other and to said terminal longitudinal axis to restrain degradation of the conductor core when the conductor is received therebetween;

said forked member further comprising first and second mouth walls defined on said first and second limbs respectively, said first and second mouth walls being disposed at an outwardly opening angle with respect to each other, extending from said slot, to form a tapered guide mouth for stripping and guiding conductors into said slot, said first and second mouth walls being substantially parallel to said terminal longitudinal axis to restrain degradation of the conductor core when the conductor is moved therebetween.

2. A self-stripping terminal according to claim 1, wherein said second limb is also carried by the free end of a resilient arm.

3. A self-stripping terminal according to claim 1, wherein one at least of said resilient arms is prestressed so that, in an initial condition, it applies a force causing one of the limbs to bear against the other.

4. A self-stripping terminal according to claim 2, wherein said structure is a U-shaped structure and said resilient arms are mounted on said portions thereof, said resilient arms being bent towards the interior of the profile of said U-shaped structure and being inclined with respect to said longitudinal axis of said terminal.

5. A self-stripping terminal according to claim 4, wherein said fork limbs are carried on said resilient arms with a rounded portion between each fork limb and its respective resilient arm.

6. A self-stripping terminal according to claim 4, wherein the base of said U-shaped structure, beneath each of said resilient arms, is cut away, each portion cut away extending longitudinally from the position of attachment of said arm to the corresponding side portion below said arm and transversely inwardly of said terminal, beyond the projection of inner face of said arm onto the plane of the base.

7. A self-stripping terminal according to claim 1, wherein said structure is U-shaped, said two limbs of said resilient fork being carried by the non-fixed ends of respective resilient arms which are fixed by attachment of their other ends to the sides of said U-shaped structure; and, the base of said U-shaped structure extending below the resilient arms and beyond the resilient fork, forming a semi-rigid second fork comprising two rigid limbs which are separated by a rigid slot provided in the end of said base, parallel to the slot in said resilient fork.

8. A self-stripping terminal according to claim 1, further comprising a further fork facing said fork, said further fork also comprising two limbs which are carried by the non-fixed ends of two resilient arms which are fixed by attachment of their other end to the sides of a second support structure, both said structures being connected by a common base.

9. A self-stripping terminal according to claim 6, further comprising a connection terminal having a second resilient fork defined between opposed fork limbs, having a second slot having a beveled mouth portion and each said limb having a groove to restrain the conductor from radial disengagement from said second fork;

said grooves each being in the form of a cut-out portion in the respective limb, which cut-out portion opens into the slot and towards the base, and being such that the part of the slot which is closest to the base is wider than the part of the slot which is closest to said second mouth portion, said two parts each being defined between two flat walls which are parallel to each other and to the longitudinal axis of the terminal, and the walls of said two parts being connected, on each limb, by a flat wall which is perpendicular to the walls of said parts.

10. The terminal of claim 1 further comprising an insulating carrier of complementary shape, to said structure, anchoring said structure.

11. The terminal of claim 10 wherein said first resilient arm bears against the sides of the insulating carrier in which said structure is anchored, to reinforce said first resilient arm.

12. The terminal of claim 10 wherein a second portion of said first resilient arm is near said insulating carrier, whereby it will abut said carrier after being bent a predetermined amount.

13. A self stripping terminal comprising a generally U-shaped structure including a base and facing sides forming a conductor-receiving channel;

said sides being extended at one end thereof to definie resilient gripping means allowing the insertion and retention of a complementary male terminal;

said sides being extended along a rounded portion at their other end to form arms movable free of said base;

said arms having free ends terminating in a first resilient fork;

said fork including two limbs extending opposite each other and forming a slot therebetween substantially perpendicular to said base;

said slot having parallel flat walls;

said walls being outwardly inclined in the upper part thereof to form a mouth opening into said slot.

14. The terminal of claim 13, wherein said base extends beyond said arms and terminates in an upturned, semi-rigid fork;

said fork comprising two rigid arms separated by a slot;

said slot lying substantially parallel to said slot of said first fork.

15. The terminal of claim 13, further including a second generally U-shaped structure connected to said structure by said base;

said second structure having rigid sides integral with said base;

said sides being exended along a rounded section to form two arms resiliently movable of said base;

said arms having free ends terminating in a second fork facing said first fork;

said second fork including two limbs extending opposite each other and forming a slot perpendicular to said base;

said slot having parallel flat walls;

said walls being outwardly inclined in the upper part thereof to form a mouth opening into said slot;

said slot lying substantially in the same plane as said slot in said first fork;

said slots being spaced apart over said base.

16. The terminal of claim 15, wherein each of said limbs forming said second fork has a groove to restrain a conductor from radial disengagement from said second fork;

said grooves each being in the form of a cut-out portion in the respective limb, which cut out opens into said slot and towards said base, and being such that the part of the slot closest to said base is wider than the part of the slot closest to the mouth of said second fork, said two parts being defined between two flat walls which are parallel to each other and to the longitudinal axis of the terminal, and the walls of said two parts being connected on each limb by a flat wall perpendicular to the walls of said parts.

* * * * *